United States Patent [19]

Baran

[11] 4,307,666

[45] Dec. 29, 1981

[54] SHOT START PROJECTILE APPARATUS

[75] Inventor: Anthony F. Baran, Fallston, Md.

[73] Assignee: The United States of America as represented by the Secretary of the Army, Washington, D.C.

[21] Appl. No.: 99,280

[22] Filed: Dec. 3, 1979

[51] Int. Cl.[3] ..... F42B 31/00

[52] U.S. Cl. ..... 102/525; 102/501

[58] Field of Search ..... 102/92.1–92.7, 102/93, 94, 91, 92, 501, 520, 524, 525

[56] References Cited

U.S. PATENT DOCUMENTS

| | | | |
|---|---|---|---|
| 1,201,935 | 10/1916 | Campbell | 102/94 X |
| 2,447,033 | 8/1948 | Shapiro | 102/94 X |
| 3,961,580 | 6/1976 | Burnett | 102/93 |

FOREIGN PATENT DOCUMENTS

| | | | |
|---|---|---|---|
| 698998 | 11/1940 | Fed. Rep. of Germany | 102/93 |
| 704406 | 3/1941 | Fed. Rep. of Germany | 102/93 |

*Primary Examiner*—Harold D. Tudor

*Attorney, Agent, or Firm*—Nathan Edelberg; Robert P. Gibson; Max Yarmovsky

[57] ABSTRACT

The present invention discloses a shot-start projectile apparatus for a worn gun tube. The apparatus can be fitted to a projectile as an auxilliary obturator or can be designed to the proper weight and used as the projectile. The apparatus comprises a torque bolt, a rear band, an alignment sleeve, a front band and an alignment nut. The front and rear bands are identical and they are made of metallic or non-metallic material. The remaining components of the apparatus are made of metal. The front and rear bands provide obturation to prevent hot propellant gases from leaking in front of the projectile.

4 Claims, 8 Drawing Figures

LOAD TO START MOTION vs. TORQUE APPLIED TO PROJECTILE

SHOT START PROJECTILE APPARATUS

GOVERNMENTAL INTEREST

The invention described herein may be manufactured, used and licensed by or for the Government for governmental purposes without the payment to me of any royalty thereon.

BACKGROUND OF THE INVENTION

The present invention relates to the field of art dealing with projectiles. More particularly, the present invention relates to an apparatus which can be secured in a new or worn gun tube to obtain improved ballistic results.

A worn gun tube produces many variations in interior and exterior ballistic performance and makes the determinations of performance parameters unreliable. Gun tubes erode from repeated firings by the movement of high temperature gases and residues generated from burning propellant, by chemical action and by friction between the projectile and bore. As the gun tube erodes, the initial pressure required to accelerate the projectile is reduced and hot gases escape around the projectile causing increased wear and a substantial reduction in projectile velocity and launch stability. In order to solve this problem, the following two methods are known in the prior art.

First method is to machine or mold a rotating band or obturator of larger diameter than the eroded cross section of the barrel at the critical seat position. This requires a slightly larger band or obturator for each firing or several made to the same oversize diameter. However, the first band would be difficult to position properly and the last would tend to be easy to position properly.

A second method is to rechamber the gun tube in a machine shop, thereby making the gun tube shorter or boring out the chamber to replace the removed material with a sleeve having the original chamber dimensions.

The basic shortcoming in prior art methods have related to an absence of improved ballistic results. Further, said methods are time consuming and produce additional problems to the ballistician and test personnel. This problem has, in the prior art, proven to be a formidable one. Accordingly, the present invention is intended as a solution to said problems.

SUMMARY OF THE INVENTION

The present invention discloses a shot-start projectile apparatus for a worn gun tube. The apparatus can be fitted to a projectile as an ancillary obturator or can be designed to the proper weight and used as the projectile. The apparatus comprises a torque bolt having a shaft threaded at one end and having a head at the opposite end thereof, a rear band having conical surfaces, said band being disposed on the shaft of the torgue bolt with an outside chamfer facing the threaded shaft when positioned against the torque bolt head; an alignment sleeve engaging the conical surfaces of the rear band; a front band symmetrical in shape with the rear band and the front band having engagements against the alignment sleeve; and an alignment nut having a conical surface facing the front end in which inside thread of the nut securely engages all of the components of the apparatus. The front and rear bands can be made from metallic or non-metallic material. The remaining components are made of metal. The alignment nut is considered the front of the projectile. The front and rear bands provide obturation to prevent hot propellant gases from leaking in front of the projectile.

It is an object of the present invention to provide an apparatus that can be fitted to a projectile as an ancillary obturator or designed to the proper weight and used as the projectile.

It is a further object of the present invention to provide an apparatus which can be easily secured in a new or worn gun tube to obtain a desired initial pressure in the chamber that will insure proper ignition and burning of the propellant to achieve improved ballistic results.

It is a yet further object of the present invention to provide improved usefulness to a worn gun tube which is considered as unserviceable.

It is a still further object of the invention to reduce gun tube wear.

DETAILED DESCRIPTION OF THE INVENTION

Figure 1:
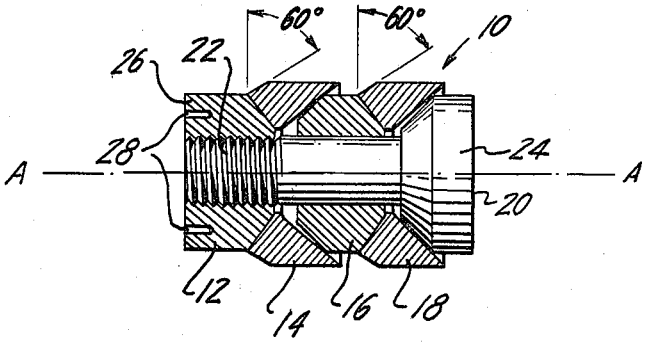
FIG. 1 is a partial cross-sectional view of a shot-start projectile apparatus, in an assembled form.

As shown in FIG. 1, a shot-start projectile apparatus 10 is illustrated as an assembled apparatus comprising an alignment nut 12, a front band 14, an alignment sleeve 16, a rear band 18, and a torque bolt 20. The front and rear bands 14 and 18 are identical and they can be made from metallic or nonmetallic material. The alignment nut 12, the alignment sleeve 16 and the torque bolt 20 are made of metal. The front end of the band has the outside diameter chamfered with an included angle of approximately 60 degrees. The torque bolt 14 comprises a threaded shaft 22 at one end and a head 24 at opposite ends of the shaft.

Figure 2:
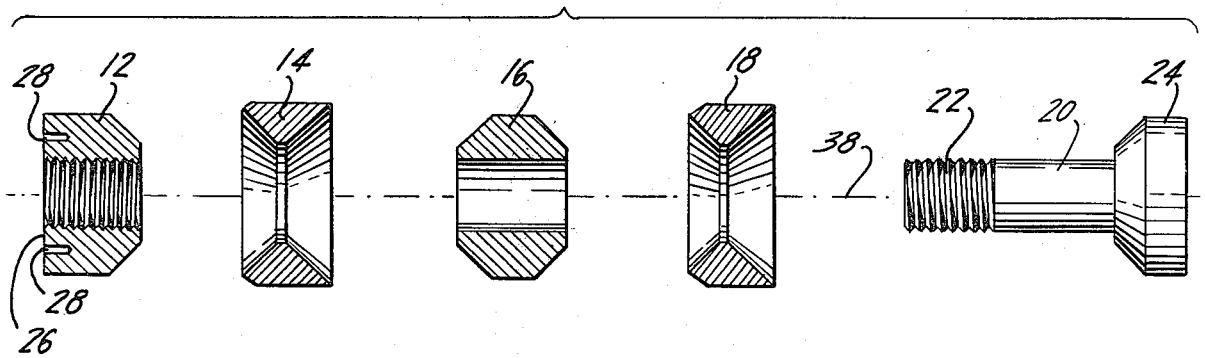
FIG. 2 is an exploded view of all the elements of the apparatus in unassembled form.

As shown in FIG. 2, the rear band 18 is placed on the shaft of the torque bolt 20 with the outside chamfer facing the threads of the shaft when positioned against the torque bolt head. The alignment sleeve 16 is placed on the shaft of the torque bolt followed by the front band 14. The front band 14 is placed on the shaft to be symmetrical with the rear band 18. The alignment nut 12 is then threaded by hand on the torque bolt shaft, with the conical surface facing the front band 14, until all the components of the apparatus 10 are finger-tight.

The apparatus 10 is inserted in the gun tube (not shown) to the projectile seat position. The torque bolt 20 is rotated clock-wise while holding the alignment nut 12 from rotating. This causes the conical surfaces, having an included angle of approximately 90 degrees, of the alignment nut 12, alignment sleeve 16 and the torque bolt 20 to engage against the conical surfaces of the front and rear bands 14 and 18. As the alignment nut 12 and the torque bolt 20 are tightened, the front conical angle of the alignment sleeve 16 and the torque bolt 20 engage more surface area of the rear included conical angle of approximately 84 degrees of the front and rear bands 14 and 18. The torque applied to the torque bolt 20 determines the normal force N with which front and rear bands exert against the gun tube wall. The actual static force $F \leqq \mu N$ where $\mu$ is the coefficient of static friction.

A charge, not shown, is placed into the weapon chamber and the breech closed. As ignition occurs, the pressure increases and with the flame spreading provides the proper media for good ignition and burning of the main charge. The pressure produced by the burning of the main charge overcomes the static friction force and the projectile is propelled down the gun tube by the rapidly increasing pressure. The front and rear bands 14 and 18 respectively provide obturation to prevent hot propellant gases from leaking in front of the projectile.

The alignment nut 12 has a flat end 26 which contains four small diameter holes 28 which are 90 degrees apart and are the same radial distance from the center line of the nut to accept a four pronged socket used to tighten the apparatus 10. The opposite end has an included conical angle of approximately 90 degrees used to align the front band 14 and force the band radially against the gun tube wall, not shown.

The front band 14 is a band/obturator. The position of the 60 degree included chamfer on the outside diameter is the front. The internal front conical angle of 90 degrees mates with the conical angle of the alignment nut 12. The internal rear conical angle of approximately 84 degrees does not mate with the conical angle of the alignment sleeve 16. Therefore, as the assembly is tightened more band surface area is forced against the tube wall increasing the normal force.

The alignment sleeve 16 is a symmetrical spacer used to transmit equal force against both the front and rear bands as the assembly is tightened. The included angles of both ends are approximately 90 degrees.

The rear band 18 is identical to the front band 14 and is positioned with the outside chamfer angle facing the alignment nut 12. The internal front conical angle is the same as the conical angle of the alignment sleeve. The internal rear conical angle of approximately 84 degrees does not mate with the conical angle of the torque bolt. Therefore, as the assembly is tightened more band surface area is forced against the tube wall increasing the normal force.

Figure 3:
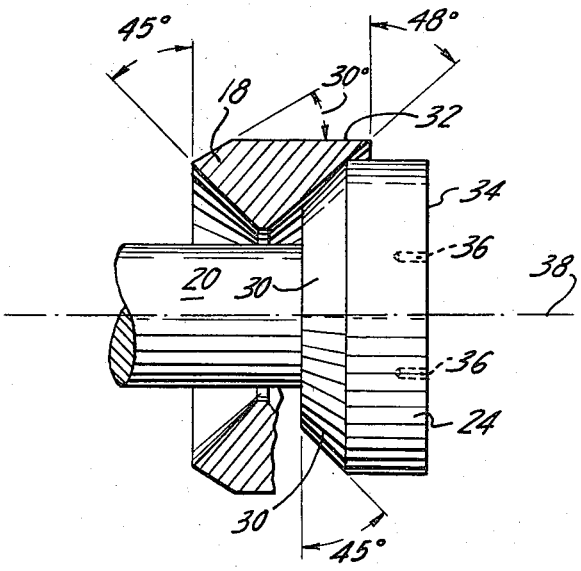
FIG. 3 is a partial breakway view taken along line A—A of FIG. 1 showing inside cross-sectional view, the angular relationship between the torque bolt and the rear band of the apparatus.

As shown in FIG. 3, the conical taper 30 of the head 24 is machined to a close tolerance for support of the alignment sleeve. The included conical angle is 90 degrees. This angle is larger than the mating angle of the rear band 18. Therefore, as the assembly is tightened more band surface area 32 is forced against the tube wall increasing the normal force. The rear face 34 of the torque bolt has four small diameter holes 36 which are positioned 90 degrees apart and are the same radial distance from the center line 38 of the bolt 20 to accept a four pronged socket, not shown, which may be used to tighten the apparatus 10.

The outside diameter of the bands 14 and 18 are slightly larger than the diameters of the other three parts 12, 16 and 24 of the apparatus 10.

Figure 4:
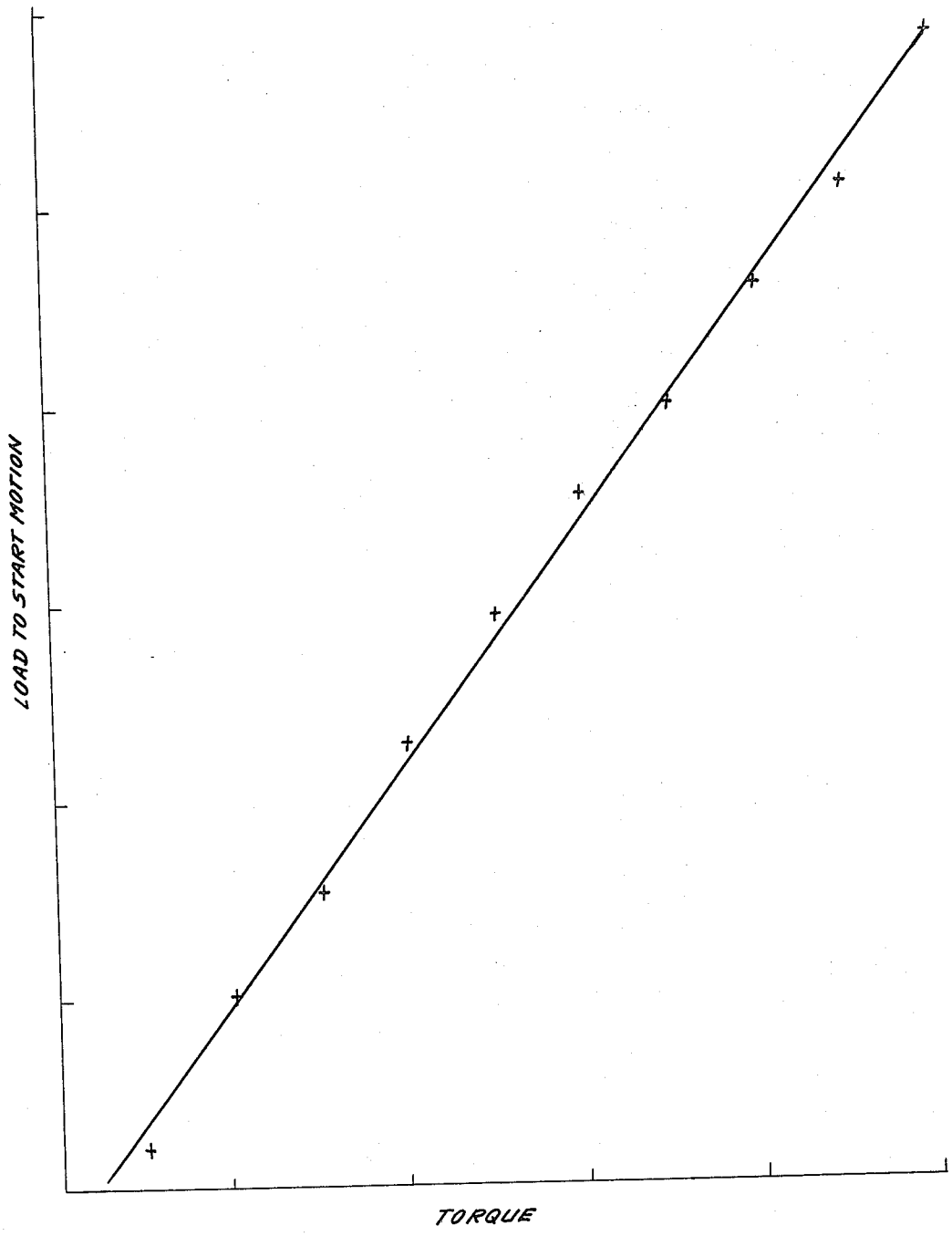
FIG. 4 is a graph of Load to Start Motion V. Torque Applied to Projectile.
Figure 5:
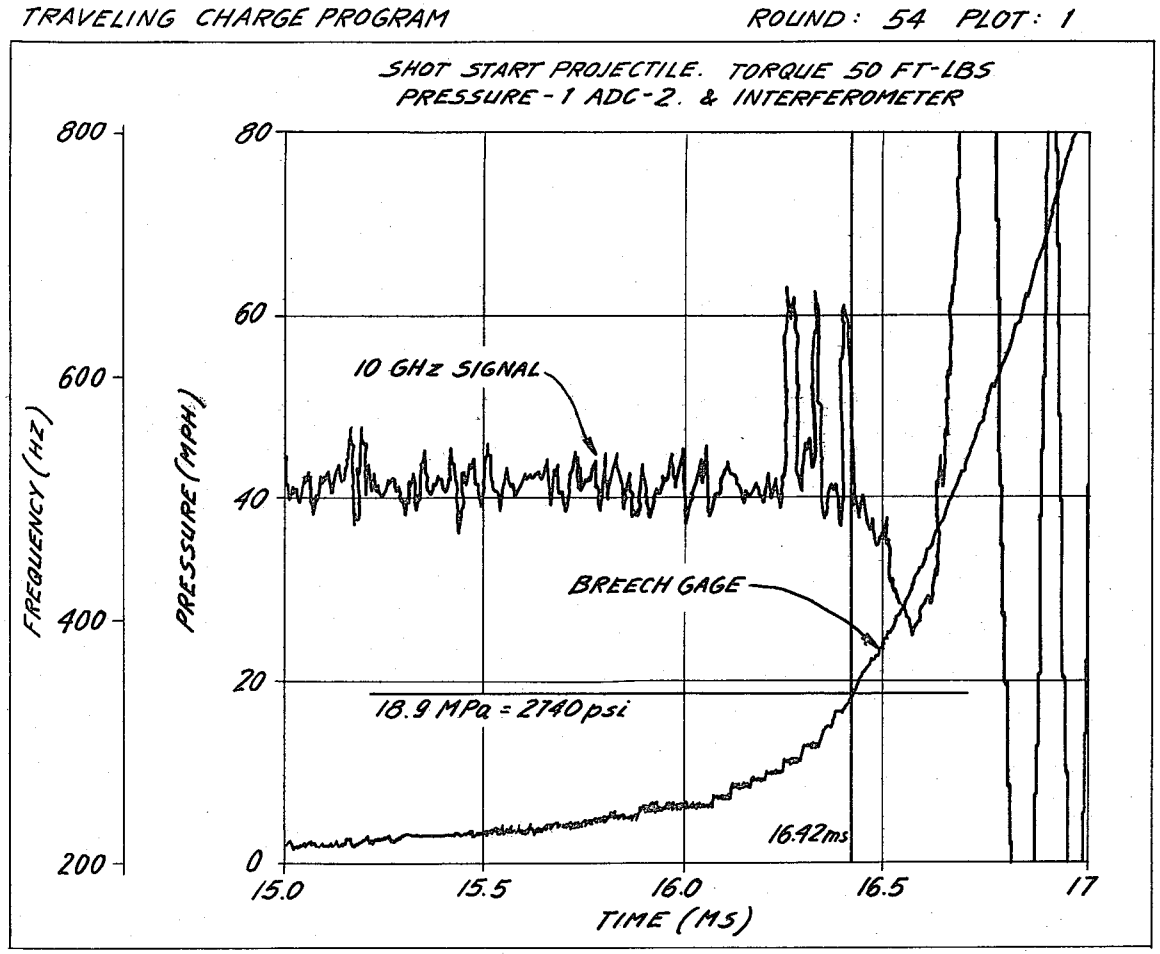
FIG. 5 is a graph of Pressure V. Time, for round 54.
Figure 6:
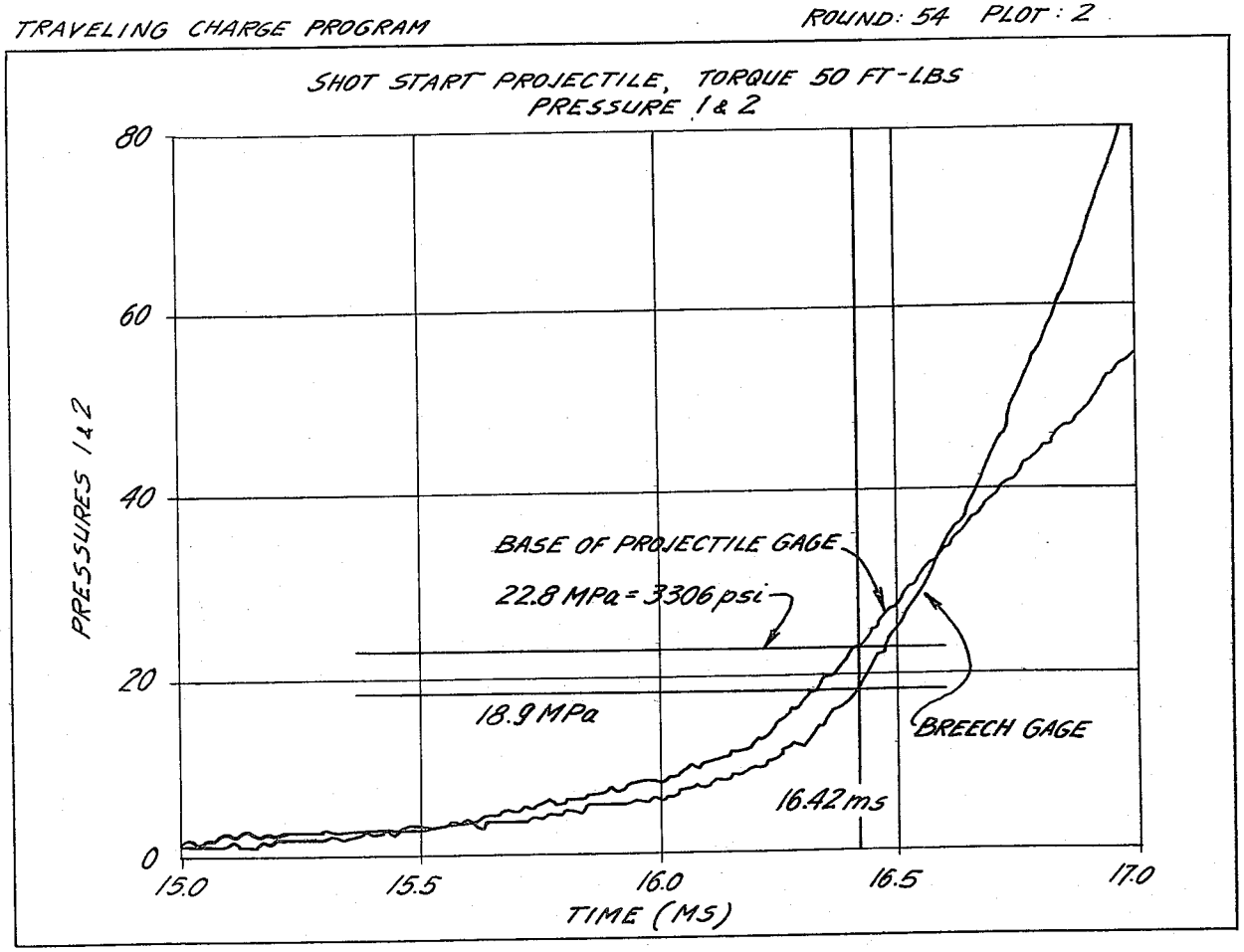
FIG. 6 is a graph of Pressure V. Time for round 54 illustrating comparison of the output of the breech pressure gage and the base of projectile gage.

The shot-start projectile apparatus 10 has been designed, fabricated, calibrated and successfully tested. The alignment nut 12, alignment sleeve 16 and torgue bolt 20 have been fabricated from aluminum and the front band 14 and rear band 18 have been fabricated from such material as polyethelene. The shot-start projectile was positioned in a section of discarded 'mm gun tubes at specific torque settings. A rod was placed against the base of the projectile and a Baldwin testing machine was used to obtain the static load necessary to start motion. This data is plotted and presented in FIG. 4. A 40 mm smooth bore gun tube has been used to measure the shot-shart pressure. "Minihat" pressure transducers are mounted in the gun tube at the breech end of the chamber and at the position where the base of the projectile is prior to firing. A 10 GHz microwave interferometer was used to obtain the start of projectile movement and its travel throughout the length of the gun tube. Data from two of the rounds fired, 54 and 56, are presented in plotted form in FIGS. 5 through 8. The interferometer and breech pressure V: time of each round are presented in FIGS. 5 and 7. The output of the breech pressure gage and the gage where the base of the projectile is positioned V time for each round are plotted in FIGS. 6 and 8. The measured pressure at the base of the projectile at start of projectile motion for round 54 is 22.8 MPa (3306 psi) and for round 56 is 11 MPa (1595 psi).

Figure 7:
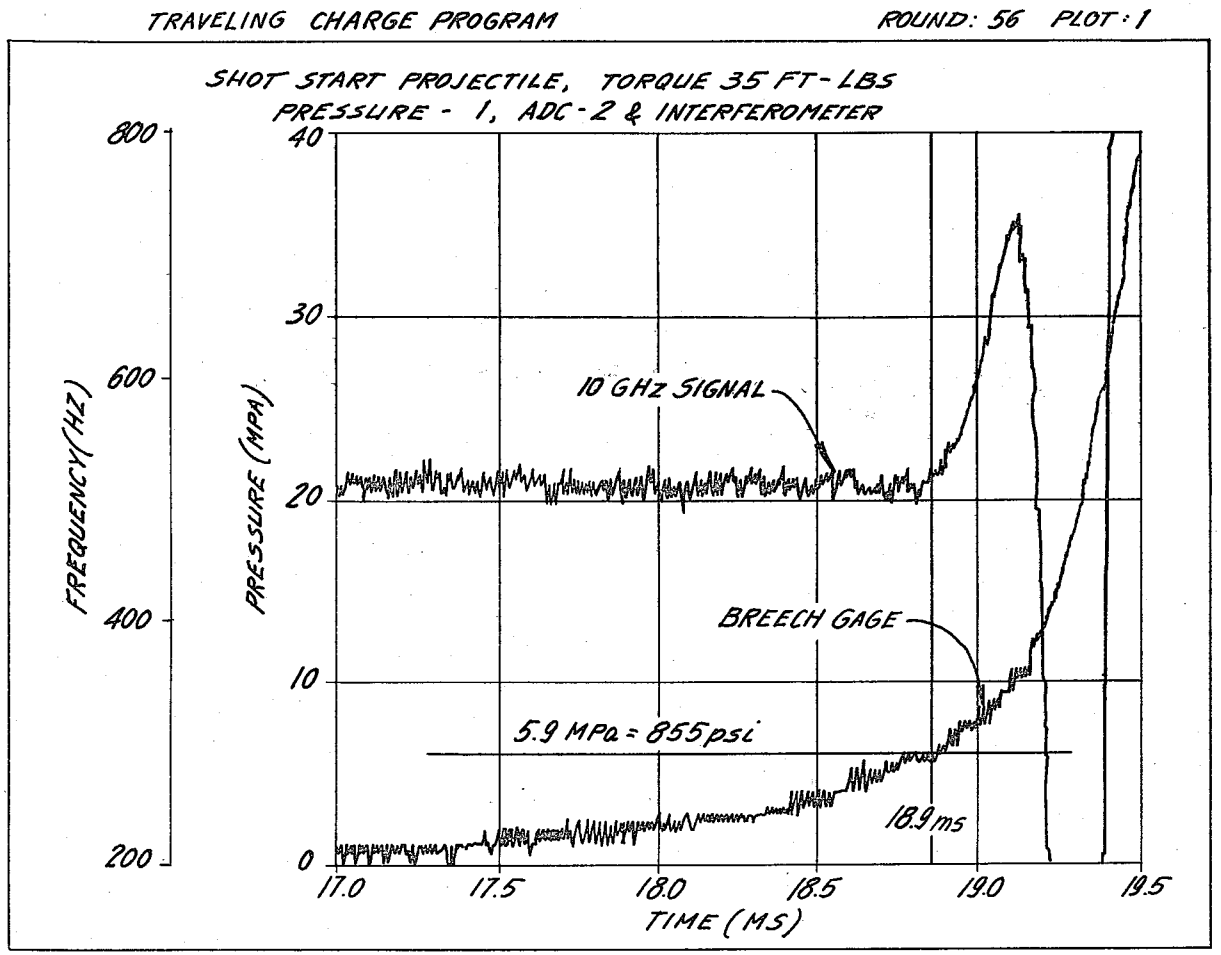
FIG. 7 is a graph of Pressure V. Time for round 56.
Figure 8:
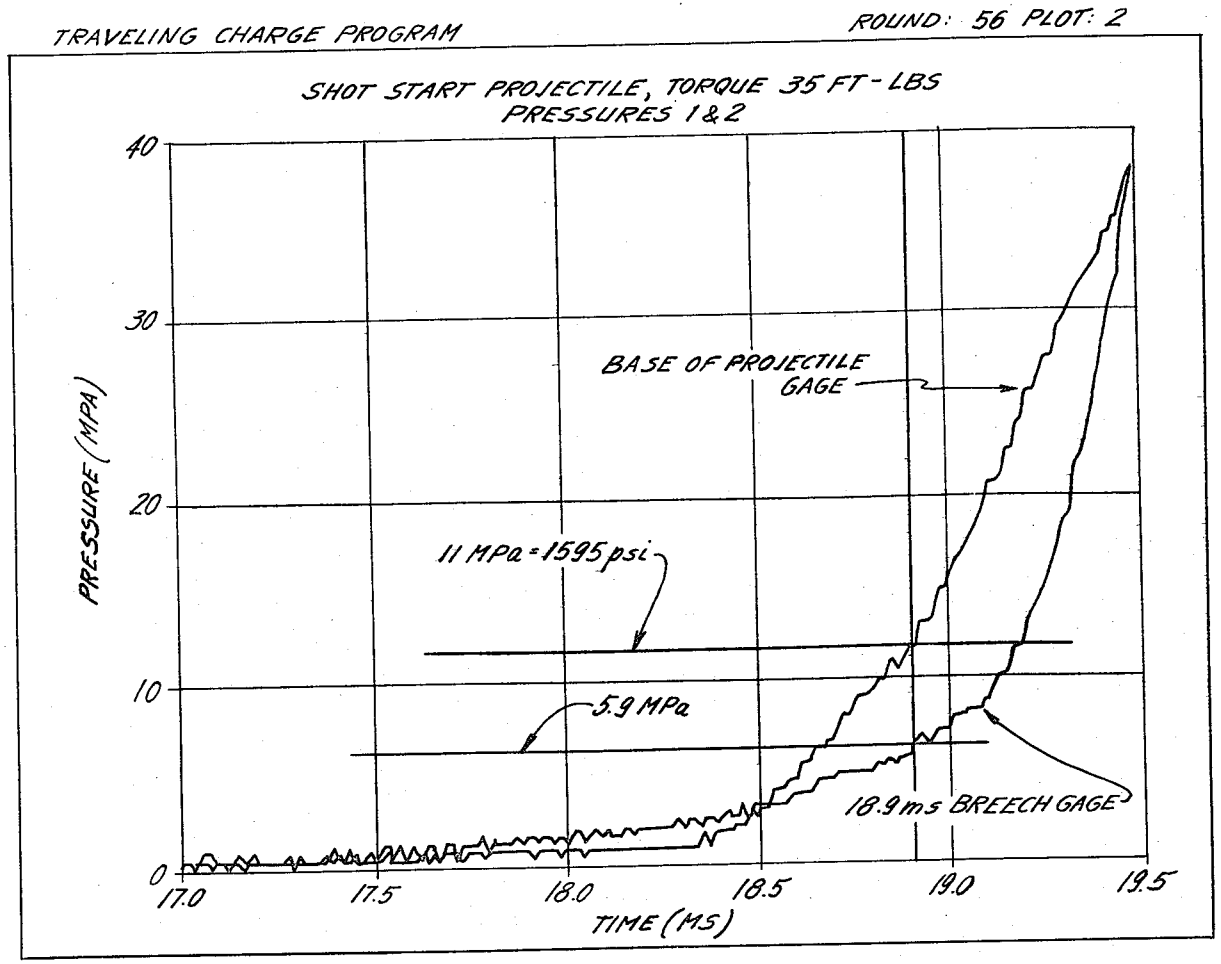
FIG. 8 is a graph of Pressure V. Time for round 56 illustrating comparison of the output of the breech pressure gage and the base of projectile gage.

As shown in FIG. 7, when the 10 GHz signal deviates from its baseline, motion of the projectile has started. A vertical line was drawn at this point to intersect the breech gage output to determine the breech at this point in time. A vertical line is drawn on FIG. 8 at the same point in the time scale. Where this line crosses the output signal of the gage positioned at the base of the projectile determines the shot-start pressure. The breech gage is also plotted as a position check.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

I claim:

1. A shot-start projectile apparatus for a worn gun tube, which comprises:

(a) a torque bolt having a shaft, said shaft being threaded at one end and having a head at the opposite end thereof which includes a conical taper thereon;

(b) a rear band having a plurality of unequally angled conical surfaces, said rear band having an outside chamfer thereon, said outside chamfer facing the threaded shaft when one of the conical surfaces of the rear band is positioned on the shaft against the conical taper of said torque bolt head;

(c) an alignment sleeve having conical surfaces on each end thereof, one end engaging one of the other conical surfaces of the rear band;

(d) a front band having a plurality of unequally angled conical surfaces, said band being symmetrical in shape to said rear band, said rear band and said front band having conical surface engagements against said alignment sleeve; and (e) an alignment nut having a conical surface facing said front band, in which inside thread of said nut securely engages the threaded shaft of said torque bolt.

2. The shot-start projectile apparatus as recited in claim 1 in which said torque bolt shaft, upon tightening comprises means for producing a normal force between the inside surface of the gun tube and both of said bands in order to restrain projectile motion until a desired pressure is reached in said gun tube.

3. The shot-start projectile apparatus as recited in claim 1 in which the front and rear bands comprises means for providing obturation for prevention of hot propellant gases from leaking in front of the projectile, and means for axially aligning said projectile in said gun tube.

4. The shot-start projectile apparatus as recited in claim 1, in which a rear face of said torque bolt comprises a plurality of grooves in which a pronged socket is received to tighten said projectile.

* * * * *